US009814934B2

(12) United States Patent
Mabrey

(10) Patent No.: US 9,814,934 B2
(45) Date of Patent: Nov. 14, 2017

(54) BASELINE ATTENUATED MUSCLE (BAM) METHOD

(71) Applicant: Brian Alexander Mabrey, Brooklyn, NY (US)

(72) Inventor: Brian Alexander Mabrey, Brooklyn, NY (US)

( * ) Notice: Subject to any disclaimer, the term of this patent is extended or adjusted under 35 U.S.C. 154(b) by 0 days.

(21) Appl. No.: 14/726,486

(22) Filed: May 30, 2015

(65) Prior Publication Data

US 2016/0016027 A1 Jan. 21, 2016

Related U.S. Application Data

(63) Continuation of application No. 14/301,647, filed on Jun. 11, 2014, now abandoned.

(51) Int. Cl.

| | |
|---|---|
| ***A63B 21/06*** | (2006.01) |
| ***A61H 1/00*** | (2006.01) |
| ***A61H 1/02*** | (2006.01) |
| ***A61H 5/00*** | (2006.01) |
| ***A63B 23/12*** | (2006.01) |
| ***A63B 23/04*** | (2006.01) |
| *A63B 21/002* | (2006.01) |
| *A63B 21/072* | (2006.01) |
| *A63B 21/062* | (2006.01) |

(52) U.S. Cl.

CPC ..... *A63B 23/1209* (2013.01); *A61H 1/00* (2013.01); *A63B 23/0482* (2013.01); *A63B 21/002* (2013.01); *A63B 21/0628* (2015.10); *A63B 21/0726* (2013.01); *A63B 23/1281* (2013.01); *A63B 2208/0204* (2013.01)

(58) Field of Classification Search

CPC ..... A61H 1/00

See application file for complete search history.

(56) References Cited

U.S. PATENT DOCUMENTS 3,675,640 A * 7/1972 Gatts ..... A61B 5/0205 482/4

4,323,237 A * 4/1982 Jungerwirth ..... A63B 21/154 482/119

(Continued)

*Primary Examiner* — Joshua Lee

(74) *Attorney, Agent, or Firm* — Franco S. De Liguori; DP IP Group

(57) ABSTRACT

In a method of strengthening pathological muscles, the patient is subjected to a therapeutic strengthening exercise for strengthening a target muscle. The method begins at the start of the strengthening exercise in response to exacerbation of symptoms exhibited by patient. The symptoms exhibited by the patient during the strengthening exercise are minimized by a series of steps including adjusting an intensity of the strengthening exercise, limiting a range of motion of the strengthening exercise, dividing evenly a prescribed number of sets and repetitions corresponding to the strengthening exercise, dividing unevenly the prescribed number of sets and repetitions corresponding to the strengthening exercise, varying a speed at which the patient is subjected to the strengthening exercise, modifying a position of the patient for the strengthening exercise, matching a mode of the strengthening exercise to the modified patient's position, and switching between primary, secondary and tertiary actions of the patient's target muscle.

7 Claims, 4 Drawing Sheets

(56) References Cited

U.S. PATENT DOCUMENTS 4,934,694 A * 6/1990 McIntosh ..... B23P 19/066 482/137
5,078,152 A * 1/1992 Bond ..... A61B 5/224 482/9
5,466,213 A * 11/1995 Hogan ..... A61H 1/02 482/4
5,626,537 A * 5/1997 Danyo ..... A63B 24/00 482/8
5,722,937 A * 3/1998 Smith ..... A63B 21/0058 482/137
6,267,733 B1 * 7/2001 Peterson ..... A61B 5/0053 600/552
6,945,911 B2 * 9/2005 Jackowski ..... A63B 21/00 482/9
7,163,488 B2 * 1/2007 Anders ..... A63B 21/0724 482/104
RE40,401 E * 6/2008 Dardik ..... 482/9
8,052,584 B2 * 11/2011 Keiser ..... A63B 21/00072 482/100
8,187,152 B2 * 5/2012 Gravel ..... A61H 1/0274 482/1
8,915,871 B2 * 12/2014 Einav ..... A61B 5/103 601/24
9,089,736 B2 * 7/2015 Draper ..... A63B 24/0062
9,107,794 B2 * 8/2015 Ewing ..... A61H 1/024
2006/0172859 A1 * 8/2006 Davis ..... A63B 24/00 482/8
2007/0078351 A1 * 4/2007 Fujita ..... A61B 5/18 600/500
2007/0282228 A1 * 12/2007 Einav ..... A63B 21/4021 601/33
2009/0149303 A1 * 6/2009 Meisterling ..... A63B 21/0004 482/124
2014/0274565 A1 * 9/2014 Boyette ..... A63B 24/0087 482/6

* cited by examiner

BASELINE ATTENUATED MUSCLE (BAM) METHOD

BACKGROUND OF THE INVENTION

Field of the Invention

The BAM Method is a step by step series of decisions used in the strengthening of pathological muscles by minimizing the signs and symptoms during the strengthening of the pathological muscle. The name of the method is an acronym for the Baseline Attenuated Muscle, as well as for the inventor's name, Brian Alexander Mabrey, myself.

Background Information

The term pathological muscle refers to the muscle below baseline status. Healthy muscles are at baseline status and are labeled as physiological. The baseline represents the line separating the physiological muscle from the pathological muscle, any point below the baseline is pathological. Healthy muscles are at baseline status and are labeled as physiological.

Strengthening of the physiological muscle is basic. Fundamentally, when physiological muscle are overloaded, fatigue and or stressed, physiological muscles will adapt by getting stronger. However, the guidelines used in strengthening of the physiological muscle do not apply to the pathological muscle. In layman's terms the pathological muscle can be described as below the physiological baseline because of injury, illness or disease. At the point the muscle crosses the threshold of pathology, the strengthening of the pathological muscle follows a different set of strengthening guidelines. The strengthening guidelines for the pathological muscle are to prevent an exacerbation of any of the signs or symptoms of the injury, illness or disease. The pathological muscle responds to overload, fatigue and or stress by further declining in status and weakening, the opposite of a physiological muscle. The signs and symptoms include, but are not limited to, pain, fatigue, cramping, tingling, numbness, pins & needles, awareness of the joint, spasm, crepitus of any structure, or other signs and symptoms associated with the injury, illness or disease.

SUMMARY OF THE INVENTION

The BAM Method maximizes strengthening benefits, improves patient compliance, and improves rates of success by minimizing pain, and any other signs and or symptoms of the pathological muscle. The resolution of the signs and symptoms during strengthening exercises are adjusted in series by weight, range of motion, repetitions, speed, position, mode, and then by muscle order of primary, secondary or tertiary mover or order of action.

In the detailed description of the BAM method which follows, examples are presented using Patient A and Patient B. Patient A will achieve success at Step 4. On the other hand, Patient B will achieve success at Step 7. In addition, Patient B will be given an alternate scenario in which Step 7 is unsuccessful. Patient B will then proceed to step 8.

Over the years working as a physical therapist independently and as a subordinate to others, feedback has been provided as to my attributes. Supervisors have observed my ability to modify therapeutic exercise prescription in real time to assist my patients in successful completion of the exercise. In addition, supervisors have commented of the inability of many therapists to modify exercises on the spot in real time. The BAM Method is my sequence of modifications on paper.

Procedure Method—A physical therapist assesses and determines the target muscle to be pathological or baseline attenuated. The same physical therapist prescribes a therapeutic strengthening exercise, as well as prescribes the intensity the therapeutic strengthening exercise is to be performed. The BAM method begins at the start of the strengthening exercise in response to an exacerbation of signs and symptoms:

1. Adjust the exercise intensity or weight so the first set is at 60%-70% of a perceived rating of exertion (PRE) without any symptoms exacerbating. Complete exercise or, if symptoms do not resolve, continue to next step.
2. Limit the range of motion (ROM) of the exercise to the symptom free range of motion. The symptom free range of motion must be 60%-70% of the exercise's full range. Complete exercise or, if symptoms do not resolve, continue to next step. Sometimes the painful range of motion is in the middle of the entire range of motion. In this situation, use the range of motion before and after the arc of the painful range of motion.
3. Divide the sets and repetitions evenly (i.e. 6×5, 2×15). Complete exercise or if symptoms do not resolve continue to next step.
4. Divide the prescribed number of sets and repetitions unevenly. Any combination. (i.e. [1×10]+[2×5]+[1×4]+[1×2]+[2×1]). Complete exercise or if symptoms do not resolve continue to next step.
5. Vary the speed at which the prescribed therapeutic exercise is performed either decrease or increased. Complete exercise or if symptoms do not resolve continue to next step.
6. Modify position for exercise to be performed. Supported vs Unsupported. Gravity Eliminated vs Gravity Assist. Complete exercise or if symptoms do not resolve continue to next step.
7. Change the exercise mode to compliment position. Complete exercise or if symptoms do not resolve continue to next step.
8. Switch to the target muscle's secondary or tertiary action or the target action's secondary or tertiary movers. Return to step 1.

Upon successful completion of any step, go to Stage I and continue with exercise until completion at Stage II. However, if symptoms arise after the successful modification during the exercise, go to Stage III, increase rest periods and or decrease speed at which the exercise is performed. Continue until the exercise is completed at Stage II, or stop exercise as not to overwork the BAM muscle (Stage IIIa). If symptoms do not resolve exercise prescription is complete for session. Any further exercise will be intolerable for patient. Record successful sets and repetitions (Stage IIIb).

The BAM Method achieves the following benefits:

Maximizes strengthening benefits: The BAM Method maximizes strengthening benefits by allowing an increased tolerance for therapeutic exercise.

Improves patient compliance: A treatment's effectiveness is directly related to tolerance and compliance of the treatment. By minimizing the symptoms, especially pain, it attenuates the inhibitory effects of pain.

Improves rates of success: If a patient is able to tolerate and is compliant with the treatment, the treatment's rate of success will increase.

DETAILED DESCRIPTION OF THE EMBODIMENTS

Embodiments of The BAM Method of the invention are described below with reference to FIGS. 1-4.

Figure 1:
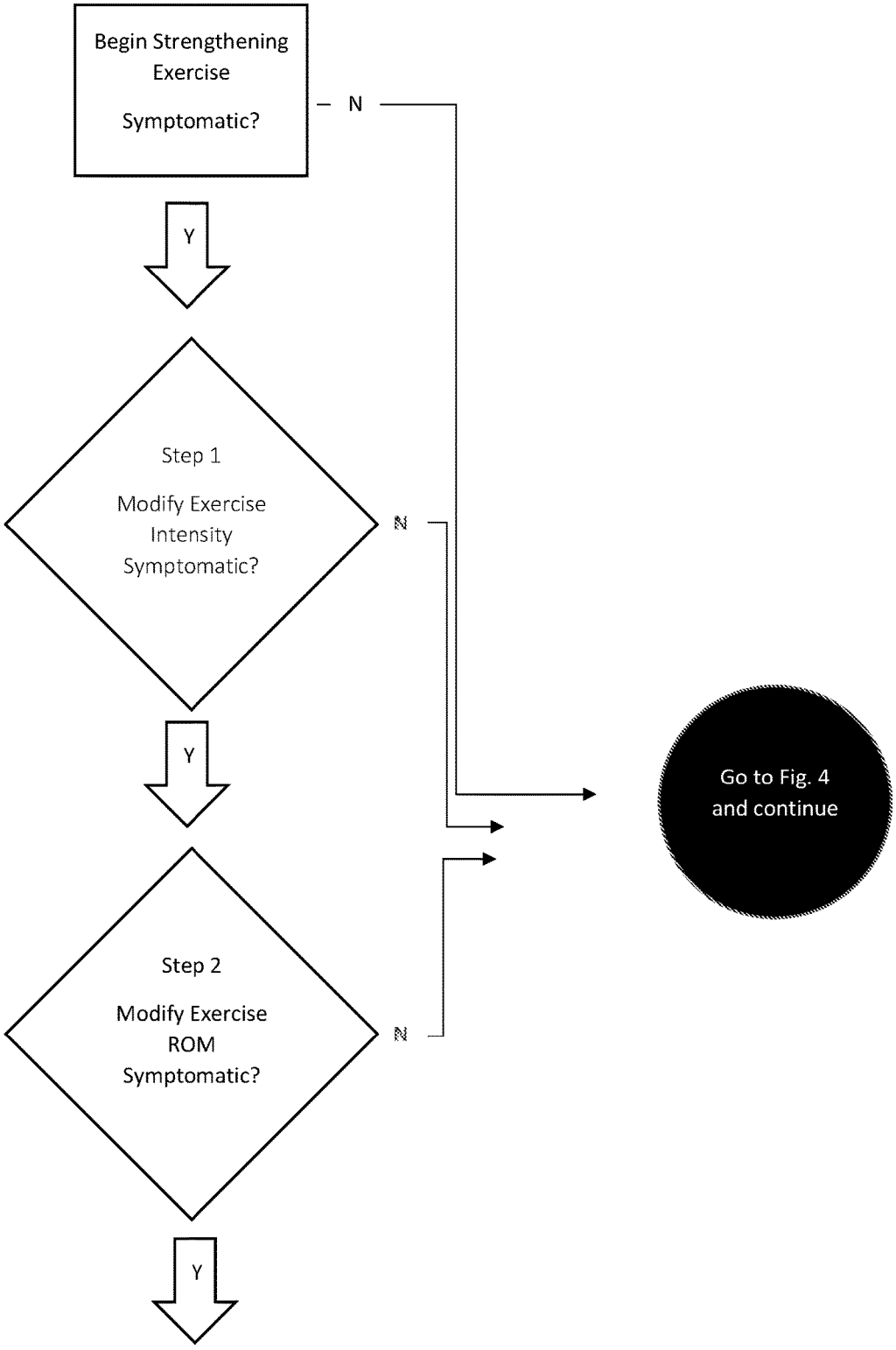
FIG. 1 is a flow diagram showing an algorithm for explaining Steps 1-2 of the BAM Method in an embodiment of the invention.

Procedure Method—begins at the start of the strengthening exercise in response to an exacerbation of signs and symptoms (FIG. 1).

1. Adjust the intensity or weight so the first set is at 60%-70% of a perceived rating of exertion (PRE) without any symptoms exacerbating (Step 1). Complete exercise (Go to FIG. 4 and continue) or, if symptoms do not resolve, continue to next step.

2. Limit the range of motion of the exercise to the symptom free range of motion (Step 2). The symptom free range of motion must be 60%-70% of the exercise's full range. Complete exercise (Go to FIG. 4 and continue) or, if symptoms do not resolve, continue to next step. Sometimes the painful range of motion is in the middle of the entire range of motion. In this situation, use the range of motion before and after the arc of the painful range of motion.

Figure 2:
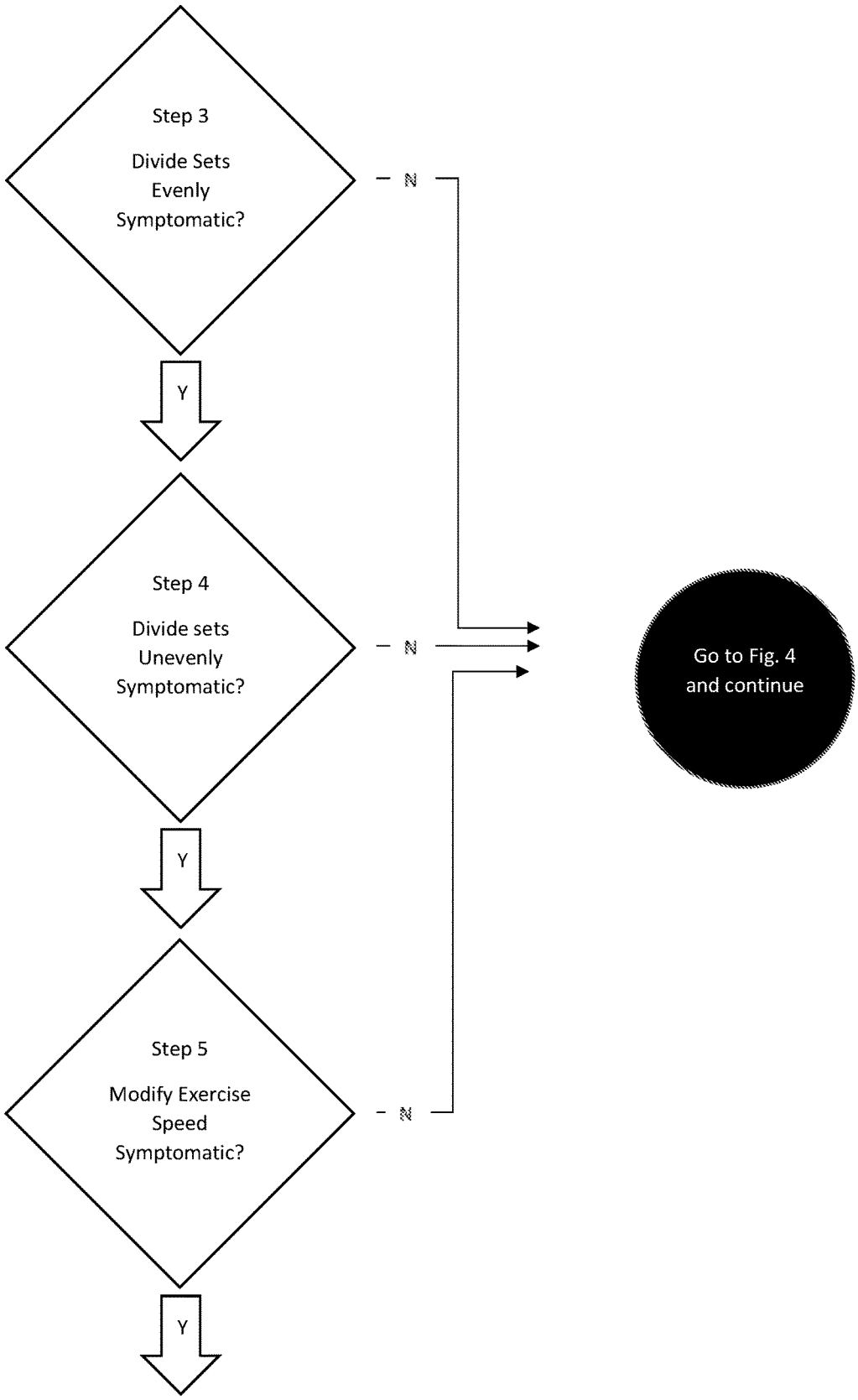
FIG. 2 is a flow diagram showing an algorithm for explaining Steps 3-5 of the BAM Method in the embodiment of the invention.

3. Divide the sets and repetitions evenly (i.e. 6×5, 2×15) (Step 3) (FIG. 2). Complete exercise (Go to FIG. 4 and continue) or, if symptoms do not resolve, continue to next step.

4. Divide the prescribed number of sets and repetitions unevenly (Step 4). Any combination. (i.e. [1×10]+[2×5]+[1×4]+[1×2]+[2×1]). Complete exercise (Go to FIG. 4 and continue) or, if symptoms do not resolve, continue to next step.

5. Vary the speed at which the prescribed therapeutic exercise is performed either decrease or increased (Step 5). Complete exercise (Go to FIG. 4 and continue) or if symptoms do not resolve continue to next step.

Figure 3:
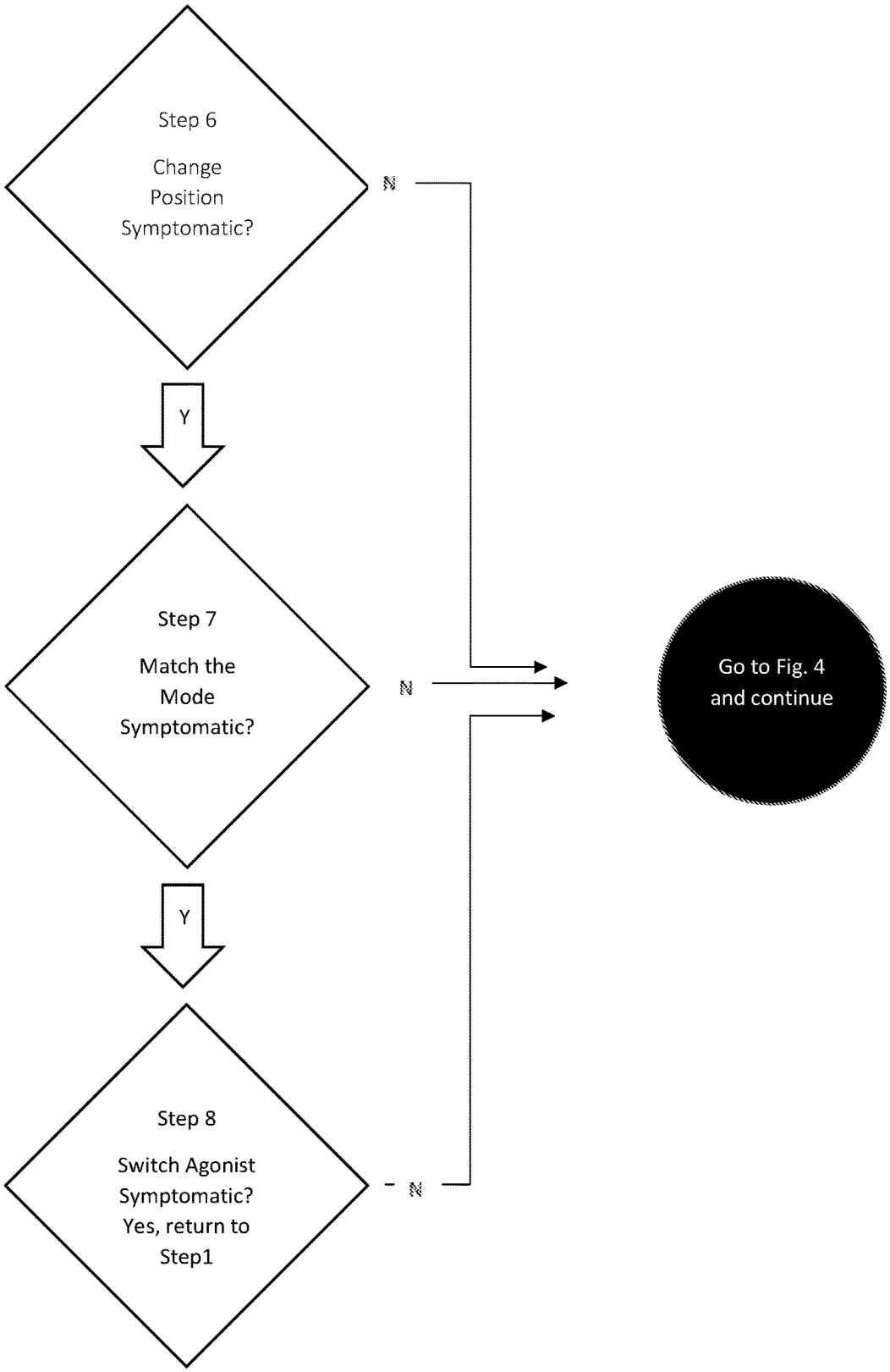
FIG. 3 is a flow diagram showing an algorithm for explaining Steps 6-8 of the BAM Method in the embodiment of the invention.

6. Modify position for exercise to be performed (Step 6) (FIG. 3). Supported vs Unsupported. Gravity Eliminated vs Gravity Assist. Complete exercise (Go to FIG. 4 and continue) or, if symptoms do not resolve, continue to next step.

7. Change the exercise mode to compliment position (Step 7). Complete exercise (Go to FIG. 4 and continue) or if symptoms do not resolve continue to next step.

8. Switch to the target muscle's secondary or tertiary action or the target action's secondary or tertiary movers (Step 8). If symptomatic, return to Step 1, otherwise continue to next step (Go to FIG. 4 and continue).

Figure 4:
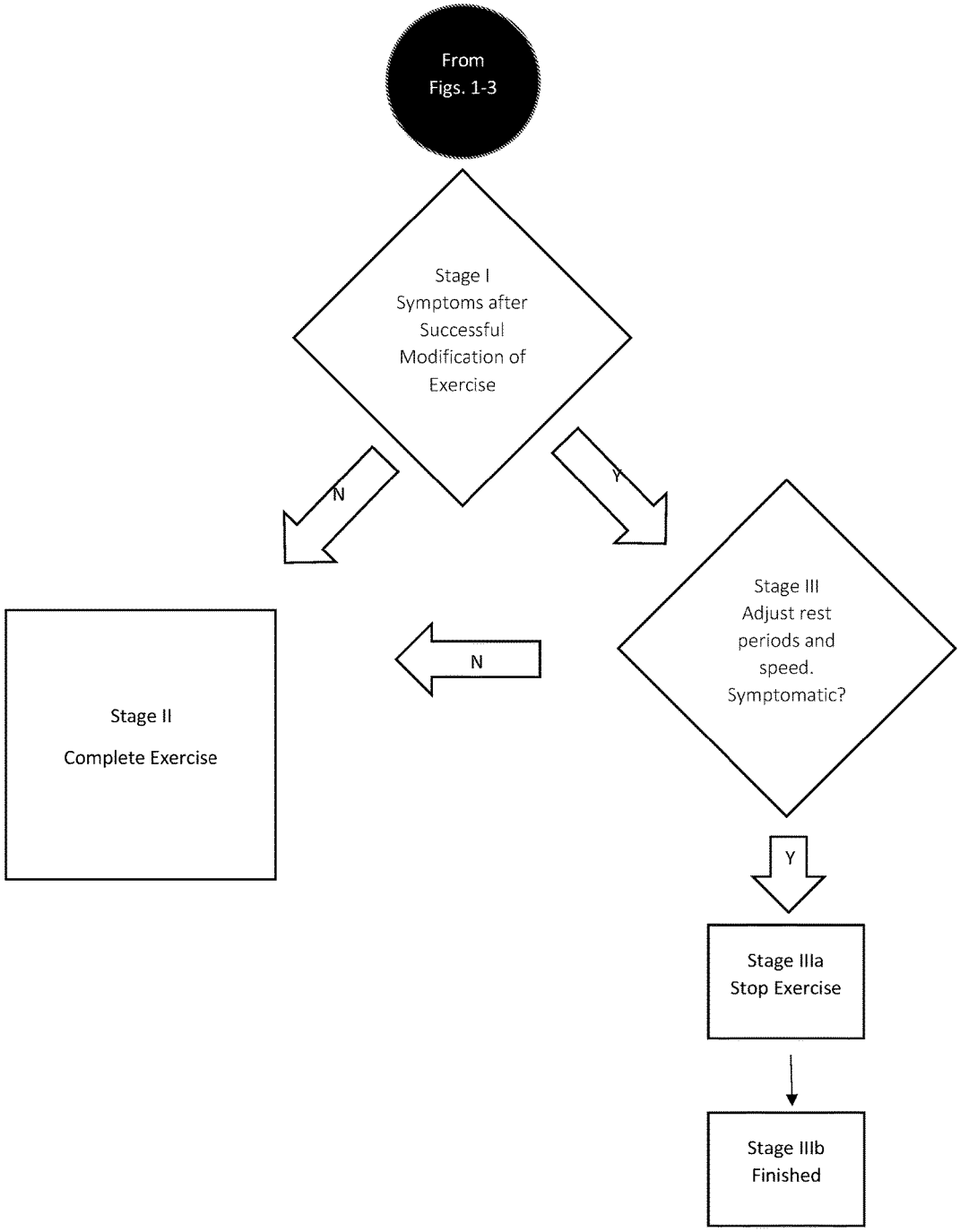
FIG. 4 is a flow diagram showing an algorithm for explaining Stages I, II, III, IIIa and IIIb of the BAM Method in the embodiment of the invention.

Referring to FIG. 4, upon successful completion of any step, go to Stage I and continue with exercise until completion at Stage II. However, if symptoms arise after the successful modification during the exercise, go to Stage III, increase rest periods and or decrease speed at which the exercise is performed. Continue until the exercise is completed at Stage II or stop exercise as not to overwork the BAM muscle (Stage IIIa). If symptoms do not resolve exercise prescription is complete for session. Any further exercise will be intolerable for patient. Record successful sets and repetitions (Stage IIIb).

Stages I, II, III, IIIa and IIIb shown in FIG. 4 are further described below:

Stage I: Symptoms after successful completion. Upon successful completion of any step, Stage II: Complete exercise until completion.

Stage III: However, if symptoms arise during the exercise increase rest periods and or decrease speed at which the exercise is performed.

Stage IIIa: Stop exercise as not to overwork the BAM muscle. If symptoms do not resolve exercise prescription is complete for session. Any further exercise will be intolerable for patient.

Stage IIIb: Record successful sets and repetitions.

Examples of the BAM Method are presented below using Patient A and Patient B. In the examples, Patient A will achieve success at step 4 while Patient B will achieve success at step 7. In addition, Patient B will be given an alternate scenario in which step 7 is unsuccessful. Patient B will then proceed to step 8.

In the following procedural example, Patient A is receiving a prescription of therapeutic exercise from a physical therapist for his shoulder. The prescribed exercise is standing shoulder flexion with a dumbbell 0-90 degrees range of motion. In this example Patient A will move through Steps 1-4, where Patient A will achieve success at Step 4.

Start the Strengthening Exercise

1. In Step 1, the therapist adjusts the prescription by increasing or decreasing the intensity or weight using a perceived rating of exertion scale where 100% is maximum effort and 0% is no effort at rest. The target progressive resistive exercise without exacerbation of signs or symptoms should be 60%-70% perceived rating of exertion. Patient A is using a 1 pound dumbbell at a 60%-70% perceived rating of exertion, however, the exercise is painful in the upper half of the range of motion.
2. For Step 2, patient A achieves symptom free shoulder flexion in a fraction of the 0-90 degree range of motion. The exercised range of motion is equal to 54 degrees (60%-70% of the exercises full range), which is rounded to 55 degrees. Patient A proceeds to next step.
3. In Step 3, patient A performs shoulder flexion without symptoms, yet the symptoms exacerbate after 5 repetitions. The prescribed number of sets and repetitions (6×5), which can be performed without the exacerbation of any symptoms. However, Patient A can only complete 4 sets of 5 repetitions without pain. Patient A proceeds to next step.
4. In Step 4, patient A is prescribed 4 sets of 5 repetitions, 2 sets of 3 repetitions and 2 sets of 2 repetitions (Any multiples to reach the target work volume of 30 repetitions). During the unevenly distributed sets and repetitions, Patient A requires increased rest periods to complete the exercise without exacerbation of symptoms. Patient A is successful.

Upon successful completion of any step, go to Stage I and continue with exercise until completion at Stage II. However, if symptoms arise after the successful modification during the exercise, go to Stage III, increase rest periods and or decrease speed at which the exercise is performed. Continue until the exercise is completed at Stage II or stop exercise as not to overwork the BAM muscle (Stage IIIa). If symptoms do not resolve exercise prescription is complete for session. Any further exercise will be intolerable for patient. Record successful sets and repetitions (Stage IIIb).

In the next procedural example, Patient B is receiving a prescription of therapeutic exercise from a physical therapist for her hip. The target progressive resistive exercise without exacerbation of signs or symptoms should be 60%-70% perceived rating of exertion. Patient B, is using a plate loaded isokinetic pulley machine set to 20 pounds to perform standing hip extension at 0-15 degrees range of motion at a 60%-70% perceived rating of exertion. The exercise is painful throughout the whole range of motion. In the example, Patient B will proceed through steps 1-7. Patient B will achieve success by step 7. In addition, an alternate scenario at step 7 will be given where Patient B must proceed to step 8 to achieve success.

Start the Strengthening Exercise

1. In Step 1, adjust by increasing or decreasing the intensity or weight using a perceived rating of exertion scale where 100% is maximum effort and 0% is no effort at rest. The target progressive resistive exercise without exacerbation of signs or symptoms should be 60%-70%. Patient B, is using 20 pounds at 60%-70% perceived rating of exertion, but the exercise is painful in the whole range of motion of 0-15. The physical therapist adjusts the exercise prescription by decreasing the weight to 10 pounds, without success. Patient B proceeds to next step.
2. For Step 2, Patient B is unable to achieve symptom free resistive hip extension despite any modifications of range of motion. Patient B proceeds to next step.
3. For Step 3, Patient B is unable to achieve symptom free resistive hip extension despite any modifications of dividing the prescribed number of sets and repetitions evenly. Symptoms are still present. Patient B proceeds to next step.
4. For Step 4, Patient B is unable to achieve symptom free resistive hip extension despite any modifications of dividing the prescribed number of sets and repetitions unevenly. Step 4 is not successful. Symptoms are still present. Patient B proceeds to next step.
5. For Step 5, Patient B is unable to achieve symptom free resistive hip extension despite any modifications of changing the speed from 90 degrees per second to 60 degrees per second. Other multiple variations of speed are also unsuccessful. Symptoms are still present. Patient B proceeds to next step.
6. In Step 6, the physical therapist adjusts the exercise prescription to perform the exercise supine.
7. In Step 7, the physical therapist then matches the appropriate exercise mode for the position adjustment. Exercise tubing is attached to the patient's ankle. The patient performs hip extension by pulling on the band with his leg starting at 50 degrees of flexion range of motion to 0 degrees range of motion (neutral). The patient is successful.

In an alternate scenario, Patient B is unsuccessful at step 7. Patient B proceeds to step 8.
8. In Step 8, if hip extension elicits pain from the primary action of the gluteus maximus, then switch to external rotation the secondary action of the gluteus maximus. Patient B proceeds back to step 1.

Upon successful completion of any step, go to Stage I and continue with exercise until completion at Stage II. However, if symptoms arise after the successful modification during the exercise, go to Stage III, increase rest periods and or decrease speed at which the exercise is performed. Continue until the exercise is completed at Stage II or stop exercise as not to overwork the BAM muscle (Stage IIIa). If symptoms do not resolve exercise prescription is complete for session. Any further exercise will be intolerable for patient. Record successful sets and repetitions (Stage IIIb).

The BAM Method Achieves the Following Benefits:

Maximizes strengthening benefits: The BAM Method maximizes strengthening benefits by allowing an increased tolerance for therapeutic exercise.

Improves patient compliance: A treatment's effectiveness is directly related to tolerance and compliance of the treatment. By minimizing the symptoms, especially pain, it attenuates the inhibitory effects of pain.

Improves rates of success: If a patient is able to tolerate and is compliant with the treatment, the treatment's rate of success will increase.

The invention claimed is:

1. A method of minimizing symptoms of injury, illness or disease during strengthening of a pathological muscle of a patient while being subjected to a prescribed therapeutic strengthening exercise, the method comprising:

adjusting an intensity of the strengthening exercise to 60%-70% of a perceived rating of exertion at the start of the strengthening exercise;

limiting a range of motion of the strengthening exercise to a symptom free range of motion corresponding to 60%-70% of a full range of the strengthening exercise;

dividing evenly a prescribed number of sets and repetitions corresponding to the strengthening exercise;

dividing unevenly the prescribed number of sets and repetitions corresponding to the strengthening exercise;

varying a speed at which the patient is subjected to the strengthening exercise;

modifying a position of the patient for the strengthening exercise;

matching a mode of the strengthening exercise to the modified patient's position;

switching between primary, secondary and tertiary actions of the pathological muscle; and wherein the prescribed therapeutic strengthening exercise comprises one of performing standing shoulder flexion using a dumbbell and performing standing hip extensions using a pulley machine.

2. The method of claim 1, wherein the step of modifying a position comprises modifying the position to one of a supported, unsupported, gravity eliminated and gravity assist position.

3. The method of claim 1, further comprising causing the patient to complete the strengthening exercise if the patient does not exhibit any symptoms of the injury, illness or disease after each of the steps of adjusting of the intensity, limiting the range of motion, dividing evenly the prescribed number of sets and repetitions, dividing unevenly the prescribed number of sets and repetitions, varying the speed, modifying the position, matching the exercise mode, and switching between primary, secondary and tertiary actions of the pathological muscle.

4. The method of claim 1, wherein the dividing unevenly the prescribed number of sets and repetitions comprises subjecting the patient to multiple sets of repetitions to achieve a target work volume of 30 repetitions with a preselected number of rest periods therebetween.

5. A method of strengthening a pathological muscle of a patient while minimizing symptoms of injury, illness or disease exhibited during strengthening of the pathological muscle, comprising:

subjecting the patient to a prescribed therapeutic strengthening exercise; and in response to exacerbation of symptoms of injury, illness or disease exhibited by the patient while being subjected to the strengthening exercise:

adjusting an intensity of the strengthening exercise to a percentage range of a perceived rating of exertion at the start of the strengthening exercise, wherein the percentage range 100% corresponds to maximum effort and 0% corresponds to no effort at rest;

limiting a range of motion of the strengthening exercise to a symptom free range of motion corresponding to 60%-70% of a full range of the strengthening exercise;

dividing evenly a prescribed number of sets and repetitions corresponding to the strengthening exercise;

dividing unevenly the prescribed number of sets and repetitions corresponding to the strengthening exercise;

varying a speed at which the patient is subjected to the strengthening exercise;

modifying a position of the patient for the strengthening exercise;

matching a mode of the strengthening exercise to the modified patient's position;

switching between primary, secondary and tertiary actions of the pathological muscle; and wherein the prescribed therapeutic strengthening exercise comprises one of performing standing shoulder flexion using a dumbbell and performing standing hip extensions using a pulley machine.

6. The method of claim 5, wherein the percentage range to which the intensity of the strengthening exercise is adjusted is 60% to 70%.

7. The method of claim 5, further comprising causing the patient to complete the strengthening exercise if the patient does not exhibit any symptoms of the injury, illness or disease after each of the steps of adjusting of the intensity, limiting the range of motion, dividing evenly the prescribed number of sets and repetitions, dividing unevenly the prescribed number of sets and repetitions, varying the speed, modifying the position, matching the exercise mode, and switching between primary, secondary and tertiary actions of the pathological muscle.

* * * * *